US007931031B2

(12) United States Patent
LeGrain

(10) Patent No.: US 7,931,031 B2
(45) Date of Patent: Apr. 26, 2011

(54) HAIRSTYLING DEVICE

(75) Inventor: Marc LeGrain, Civricux En Dombes (FR)

(73) Assignee: SEB S.A., Ecully (FR)

( * ) Notice: Subject to any disclaimer, the term of this patent is extended or adjusted under 35 U.S.C. 154(b) by 498 days.

(21) Appl. No.: 12/044,584

(22) Filed: Mar. 7, 2008

(65) Prior Publication Data

US 2008/0216860 A1 Sep. 11, 2008

(30) Foreign Application Priority Data

Mar. 7, 2007 (FR) ..... 07 01644

(51) Int. Cl.
*A45D 1/02* (2006.01)
*A45D 2/40* (2006.01)
*A45D 1/04* (2006.01)

(52) U.S. Cl. ..... 132/269; 132/224; 132/232; 219/222

(58) Field of Classification Search ..... 132/269, 132/271, 210, 211, 222–227, 229–235; 219/222, 219/227, 229
See application file for complete search history.

(56) References Cited

U.S. PATENT DOCUMENTS

| | | | | |
|---|---|---|---|---|
| 7,445,012 | B2 * | 11/2008 | Mukai | 132/224 |
| 2006/0207625 | A1 * | 9/2006 | Chan | 132/224 |
| 2008/0216859 | A1 * | 9/2008 | Chan | 132/224 |
| 2010/0078037 | A1 * | 4/2010 | Mukai | 132/223 |

FOREIGN PATENT DOCUMENTS

| | | |
|---|---|---|
| JP | 2000333719 | 12/2000 |
| JP | 2003250626 | 2/2002 |
| JP | 2002291517 | 10/2002 |
| WO | 99/25216 | 5/1999 |

* cited by examiner

*Primary Examiner* — Cris L Rodriguez
*Assistant Examiner* — Vanitha Elgart
(74) *Attorney, Agent, or Firm* — Browdy and Neimark, PLLC

(57) ABSTRACT

A hairstyling device composed of a handle (1), at least one heating part (3) cooperating with a retaining part (2), each mounted in a respective housing (6, 22; 5, 20) joined to the handle (1), at least one of the heating (3) or retaining (2) parts being float-mounted inside its housing (6, 5), hair being able to be inserted between the heating part (3) and the retaining part (2). At least one of the heating (3) or retaining (2) parts has a first permanent magnet (11) cooperating with a second, opposing permanent magnet (12) belonging to its housing (6, 22; 5, 20), the second permanent magnet being mounted in phase with the first.

15 Claims, 5 Drawing Sheets

SECTION A-A

SECTION A-A

HAIRSTYLING DEVICE

BACKGROUND OF THE INVENTION

The present invention relates to a device, or appliance, for styling or shaping the hair comprising a handle joined to a retaining part and a heating part between which a lock of hair may be inserted, more particularly a device comprising a mechanism for exerting pressure on the lock of hair to be treated.

Most hair-shaping devices, for example straightening, curling and crimping irons, comprise a handle supporting two mechanical elements, at least one of which is heated, the other element being provided for bringing the hair into contact with the first one, particularly by moving from an open position that allows the hair to be inserted to a closed position that places it in contact with the heating part. The movement from the open position to the closed position is produced manually by pressing on an opening lever of a clip that exerts pressure on the hair or by pressing two articulated arms of the device toward one another so as to bring the heating part in contact with the hair. The problem encountered with such devices is that, because they pivot about an axis of rotation that is at a distance from the treatment part, they do not provide uniform contact pressure on the hair.

The quality of heat-shaping of the hair is determined by the laws of heat transfer and depends on parameters such as the contact time, the temperature of the heat exchange, the diffusivity of the materials, the mass of the elements, and the quality of the contact.

The document EP 1 030 571 proposes a device that provides better contact between a cylindrical heating mandrel and the hair to be treated by using a pressure piece that is spring-mounted on the pivoting support clip for retaining the hair. This type of pivoting clip with a spring-mounted pressure piece increases the size of the device in the radial direction and thus only makes it possible to produce curls of fairly large diameter. Moreover, the pressure piece and the support clip are joined by a mechanical link embodied by the spring, this link being subject to friction in operation and giving rigidity to the assembly, which therefore cannot effectively adapt to fine locks of hair.

The document JP 2000-333719 proposes a similar solution in a hair-straightening device comprising two jaws, pivotably mounted about an end joint, wherein one of the jaws comprises a heating straightening plate mounted so as to be fixed relative to its support, the opposing jaw comprising a straightening plate mounted so as to be movable relative to its support in the jaw, under the pressure of a spring. The same size problem arises in the device of this document, the plates of which must be fairly thin in order for a user to be able to close them easily with one hand. Moreover, the reliability of spring-mounted pressure plates is questionable, since the spring can jam, or even break, in operation.

Similar solutions are described in other documents such as JP 2002-291517 and JP2003-250626, wherein the devices use other types of springs to produce a float-mounting of the heating plates. More particularly, the device described in the document JP2003-250626 comprises straightening plates, each of which is float-mounted by means of leaf springs on the end of a jaw, the jaws themselves being pivotably articulated at the other end in order to provide an open position and a closed position of the device. Each straightening plate comprises a magnet that cooperates with the magnet of the opposing straightening plate to guarantee the parallelism of the plates when the device is closed. These devices using a floating spring mount have the same drawbacks as those mentioned above.

BRIEF SUMMARY OF THE INVENTION

The present invention seeks to eliminate the aforementioned drawbacks and to provide a hairstyling device of reduced size that is capable of giving the hair a good, even and long-lasting shape, and of reducing the time required to treat a lock of hair.

The invention provides a hairstyling device capable of adapting to the thickness of the lock of hair to be treated, for increased reliability in operation.

The invention further provides a hairstyling device that has a simplified, compact structure and can be mass-produced at low cost.

A hairstyling device according to the invention comprises a handle, at least one heating part cooperating with a retaining part, each mounted in its respective housing joined to the handle, at least one of the heating or retaining parts being float-mounted inside its housing, the hair being able to be inserted between the heating part and the retaining part, due to the fact that at least one of the heating or retaining parts comprises a first permanent magnet cooperating with a second permanent magnet belonging to its housing, the second permanent magnet being opposing, or facing, the first permanent magnet and being mounted in phase with the first one.

A hairstyling device of this type makes it possible to insert the hair to be treated between a heating part and a retaining part (these parts forming the hair-shaping means) and then place it in contact with the heating part in order to heat-shape it. The device may comprise several heating parts cooperating with a retaining part, for example a three-finger clip. The heating part and the retaining part are each mounted, with their respective constituent parts, in a supporting housing, each housing being joined to a handle or a part for grasping the device.

According to the invention, at least one of the heating or retaining parts is float-mounted inside its housing the force of a magnetic field.

A float mount of a part relative to its housing is understood to mean a mount with play and the ability to move in at least one direction when the part is subjected to the force exerted on it by a magnetic field. A float-mount of this type allows the retaining part, the heating part, or both, one or more degrees of freedom. Such a float mount of the heating or retaining part can be produced, for example, by joining it to its support with at least one pivot- or ball-type joint that allows it to rotate about one or more axes, or with a slip-type joint that allows it to move in translation in the direction of the magnetic field.

Thus, surprisingly, it was observed in tests performed in the laboratory that a magnetic float mount of this type allowed the part subjected to movement by the magnetic field to adapt very precisely to the slightest thickness of a lock of hair inserted between the opposing heating and retaining parts. This adaptation is obtained without the slightest mechanical loss due to friction, blockage, the manufacturing tolerances of the components (any structural geometric flaws being compensated by this magnetic float mount), etc.

Such a system therefore makes it possible to accommodate the variable thickness of the lock of hair inserted into the shaping means, which are floating, and thereby transfer calories to the lock regardless of its variable thickness. This results in a shaping of the hair that is faster (there is no need to go over parts that are not treated properly in the first pass), more even, and longer lasting.

More particularly, according to the invention, the retaining part and/or the heating part comprise(s) a first permanent magnet cooperating with a second, opposing permanent magnet belonging to its housing, the second magnet being mounted in phase with the first.

Thus, the part comprising the magnets is floatingly supported by the phase magnets in phase in its own housing. Thus, the magnetic field is enclosed in the housing of this part, and does not influence the treatment area that comes in contact with the hair. This solution has the advantage of making it possible to produce a unitary structure, the magnets and the floating part both being held in the housing of this structure. Moreover, in the context of a device comprising two parts that pivot about a principal opening or closing axis, this solution offers the advantage of not interfering with the means for opening the device.

Advantageously, these magnets are disposed substantially at each end of the retaining part or heating part.

This makes it possible to better distribute the hair-clamping force along the treatment surface and to apply an even force, even in the context of clamp-type devices where the two arms pivot about a pivot axis that is at a distance from the treatment surfaces.

Preferably, the retaining part is heating.

This makes it possible to obtain improved hair-shaping, since the hair is simultaneously heat-treated by the two opposing treatment surfaces, that of the heating part and that of the opposing retaining part.

In a variant of embodiment of the device, the retaining part or the heating part has a hair treatment surface that is flat or ridged.

Such a device is more particularly intended for straightening the hair, the hair in this case being straightened between a flat treatment surface and a non-plane, i.e., a ridged surface or an edge of the retaining surface, or between two flat treatment surfaces, one of the heating part and one of the retaining part. In a variant, one of the treatment surfaces is undulating and cooperates with an opposing treatment surface having a complementary shape so as to constrain the hair as it passes between these two treatment surfaces.

Advantageously, the device comprises means for guiding the heating part or the retaining part, disposed in a midplane perpendicular to the plane of the hair treatment surface or on either side of this plane.

Such guiding means may be rotational or translational, and when they are disposed in a midplane of the treatment surface or on either side of this midplane, they ensure the application of an even force along the entire treatment surface, and consequently, along the hair to be treated.

In another variant of embodiment of the device, the heating part has a hair treatment surface having a shape generated by revolution and the retaining part has a treatment plate that conforms to the shape of the heating part.

The shape generated by revolution may be a cylinder or a cone, in which case the treatment surface makes it possible to create curls by winding the hair around the axis of the treatment surface while holding it against this surface using the retaining surface.

Advantageously, the device includes means for radially guiding the retaining part.

The retaining part is float-mounted using the force of the magnetic field; its radial guidance relative to the opposing cylindrical or conical heating part makes it possible to apply even pressure on the lock of hair to be treated, thus allowing better contact with the heating surface on which the hair is wound, along the entire length of the latter. This radial guidance may be rotational or translational guidance.

In a variant of embodiment of the device, the housings of the retaining part and the heating part are pivotably mounted about an axis perpendicular to the longitudinal axis of the handle.

Such a device makes it possible to move from an open position for inserting the hair to a closed position for performing the treatment of the hair. Such a device may be a straightening iron or a curling iron. For such devices having an axis of rotation, the float mount is preferably produced by means of a repulsive magnetic field so that this field does not interfere with the main opening means and thus no additional effort is required to open the device.

In another variant of embodiment of the device, the housings of the retaining part and the heating part are mounted so as to be fixed relative to the handle and the device comprises means for inserting the hair between the heating part and the retaining part.

This device therefore comprises a fixed frame that floatingly supports the retaining plate and/or the heating plate, and insertion means embodied in the form of a free surface, preferably curved, with chamfered or rounded edges that make it possible to insert the hair automatically or manually between the shaping means, which thus separate so as to leave room for the lock of hair to be treated. The hair is then maintained in contact with the shaping means for the entire duration of the treatment, without requiring the person using it to exert the slightest effort in order to maintain this contact.

Advantageously, the device of the invention comprises means for adjusting the force of the magnetic field.

This makes it possible to adapt the pressing force of a shaping part or parts to the type of hair to be treated, thereby reducing the force applied to the hair and the pulling sensation experienced by the user, and also providing better protection for the hair. Thus, it was observed during tests performed in the laboratory that a significant force should be applied to thick or coarse hair, and that less force should be used on fine or delicate hair. The adjusting means can be mechanical means, for example using an adjusting screw or cams that move the magnet inside its housing, thus making it possible to vary the distance between the shaping parts or between the opposing magnets. In one of their limit positions, the adjusting means can constitute release means for opening plates that are normally in contact, for example a means for rotating the magnet about its axis and changing its polarity.

BRIEF DESCRIPTION OF THE DRAWINGS

The invention will be better understood by studying the nonlimiting embodiments illustrated in the attached figures, in which.

DETAILED DESCRIPTION OF THE INVENTION

Figures 1A, 1B:
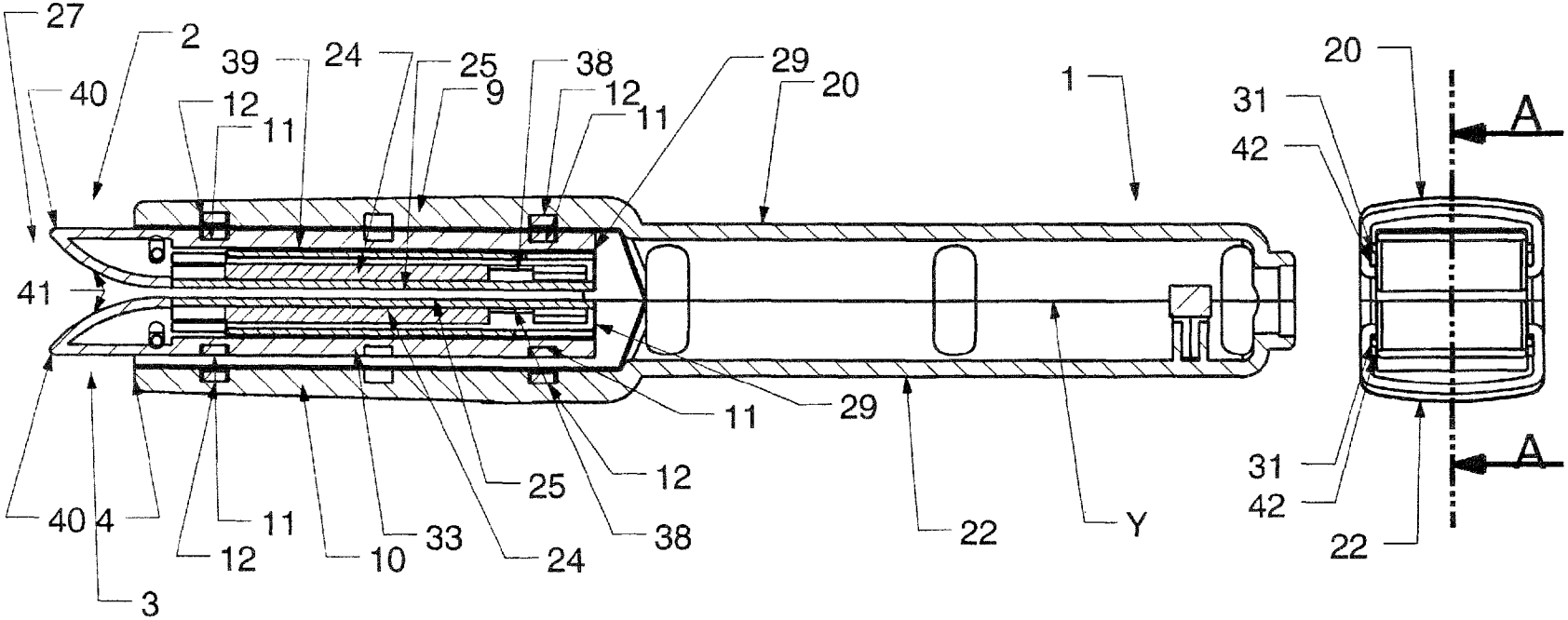
FIG. 1*a* is an axial sectional view of the device according to a first variant of embodiment of the invention, taken along the cross-sectional plane A-A in FIG. 1*b;*
FIG. 1*b* is a front view of the device of FIG. 1*a;*

The hairstyling device, or appliance, represented in FIGS. 1*a* and 1*b* is a straightening iron comprising a two-part housing, including an upper housing shell 20 and a lower housing shell 22, which are symmetrical. Shells 20, 22 are made from a plastic material using an injection technique, the rear part of the shells forming a handle 1 extended toward the front by a part for receiving and supporting hair-shaping means, including a retaining part 2 and a heating part 3. Heating part 3 can be heated electrically, by gas, by steam, etc. Heating part 3 comprises, on its outer surface intended to come in contact with the hair, a treatment surface 18 having a generally rectangular shape, made from a heat-conducting material, polished and possibly covered with an enamel, a ceramic material, a glass coating, etc. Retaining part 2 can be a simple metal plate comprising, on its outer surface intended to come in contact with the hair, a treatment surface 17 having a generally rectangular shape, polished and possibly covered with an enamel, a ceramic material, a glass coating, etc. In the examples represented in the figures, retaining part 2 is made in the same way as heating part 3 and can also supply calories to the lock of hair to be treated.

Figure 2:
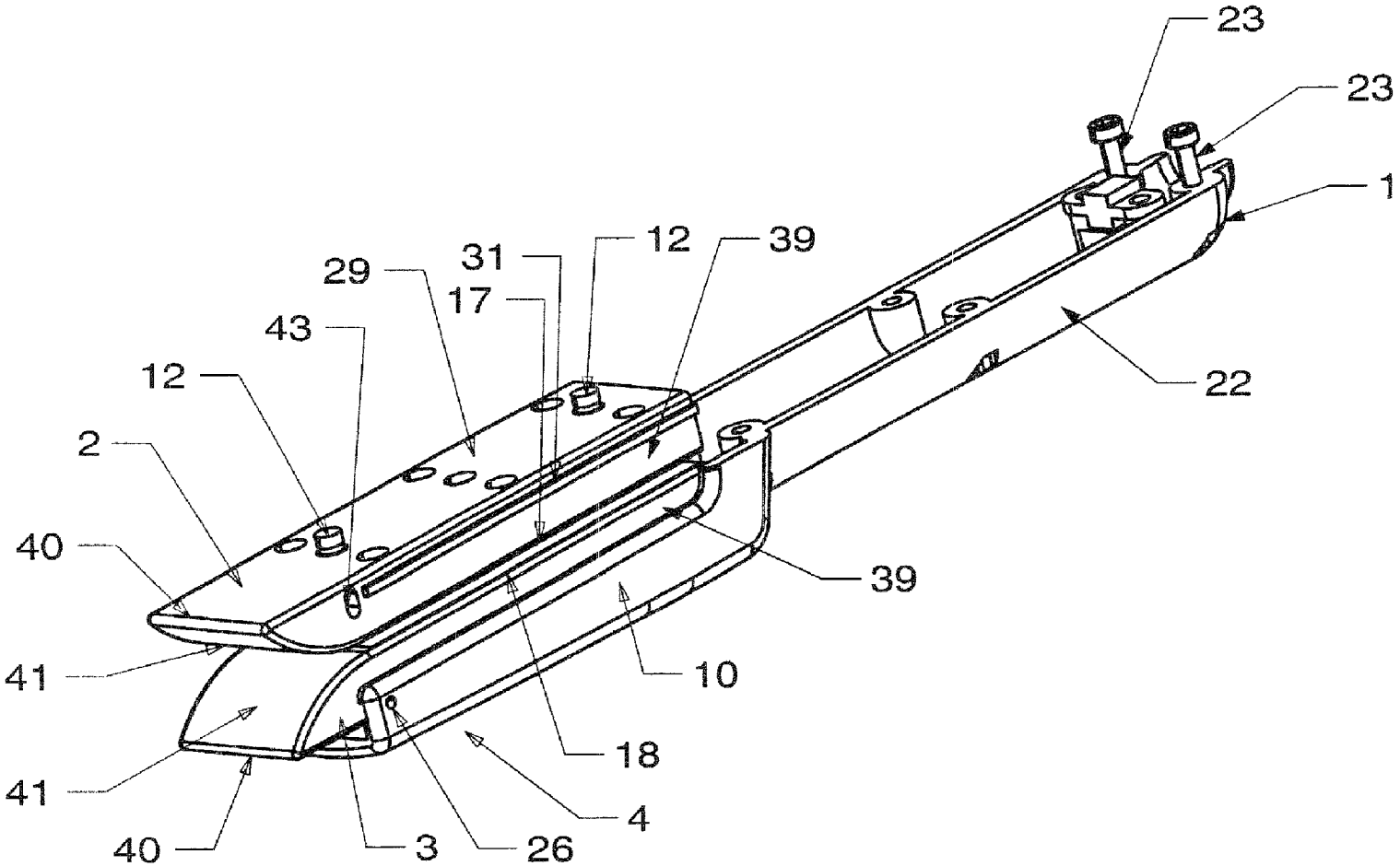
FIG. 2 is a view in perspective of the device of FIGS. 1*a* and 1*b*, with the upper part of its housing omitted for greater clarity.

As seen more clearly in FIG. 2, the retaining 2 and heating 3 parts have a generally parallelepiped shape and are each embodied in the form of a module 29 supported, in the housing of retaining part 2, by upper shell 20 (omitted in FIG. 2) and in the housing of heating part 3, by lower shell 22 of the housing. Each module 29 comprises on its two parallel lateral sides a rib 31 for mounting and guiding it in a rail 42 (FIG. 1*b*) present on each of the parallel lateral sides of shells 20 and 22 of the housing. Rails 42 of upper shell 20 and rails 42 of lower shell 22 are parallel to each other and ensure a parallel mounting of retaining 2 and heating 3 parts. A stop pin 26 that slides into a slot 43 allows each module 29 to be locked in the longitudinal direction after mounting.

In the examples represented in the figures, module 29 of retaining 2 and heating 3 parts comprises a plate 25 of generally parallelepiped shape having an internal cavity 38 that contains an electric heating element 24, for example a resistive heating element, having a PTC, or infrared emitting heating element, etc. Heating element 24 of each part is in thermal contact with plate 25 by virtue of being attached to the base wall of plate 25 that forms the respective treatment surface 17 or 18 of each treatment part in order to fully transmit the calories to the hair to be treated. Internal cavity 38 is closed by an upper wall spaced apart from the heating element. Plate 25 is mounted in a cap 39, which encases its entire periphery except for the sole that forms the respective treatment surface 17 for retaining part 2, or 18 for heating part 3.

According to the invention, module 29 is float-mounted by magnetic suspension means in its housing inside the device. In the variant represented in FIGS. 1 and 2, the housing is produced by assembling shells 20 and 22, using for example fastening screws 23 and nuts (not visible in the drawings). The housing thus produced forms a fixed frame 4, which, as seen in longitudinal section, has a U shape comprising two parallel arms 9 and 10 disposed on either side of a longitudinal axis Y, extended rearward by an elongated part forming a handle 1, the two arms being joined by the screw assembly at the level of handle 1.

As seen more clearly in FIGS. 1*b* and 2, each arm 9 and 10 has a U-shaped cross-section that allows module 29 which it floatingly supports to be seen. More particularly, according to the invention and as seen in FIGS. 1*a*, 1*b* and 2, the float mount of modules 29 inside frame 4 is produced using a magnetic field with several pairs of permanent magnets mounted in phase. Thus, upper arm 9 of frame 4 comprises two permanent magnets 12 fixedly mounted in cavities formed on the inner surface of arm 9. Magnets 12 have a cylindrical shape and are disposed so that their axes are contained in the midplane of the housing. Magnets 12 are oriented with their north poles facing outward of the mounting cavity. Module 29 associated with arm 9 also comprises two permanent magnets 11 fixedly mounted in cavities formed on the upper surface of cap 39. Magnets 11 have the same shape and the same dimensions as magnets 12 and are also disposed so that their axes are contained in the midplane of the housing. Magnets 11 are oriented with their north poles facing outward, and facing north poles of magnets 12. Likewise, lower arm 10 of frame 4 comprises two permanent magnets 12 fixedly mounted in cavities formed on the inner surface of arm 10, cylindrical magnets 12 being disposed with their axis contained in the midplane of the housing and oriented with their north poles facing outward of the mounting cavity. The module 29 associated with arm 10 also comprises two permanent magnets 11 fixedly mounted in cavities formed on the lower surface of cap 39, which have the same shape and the same dimensions as magnets 12 and are also disposed so that their axes are contained in the midplane of the housing and oriented with their north poles facing outward and facing north poles of magnets 12.

The magnets 11, 12 of each pair are disposed at a distance from one another and mutually repel each other. As a result, heating 3 and retaining 2 parts are pushed toward each other and touch at the level of their treatment surfaces 18 and 17; they can be pushed back against the force of the magnetic field by the hair to be treated, which is inserted between parts 2 and 3. The movement of each of the respective parts 2 and 3 relative to frame 4 is possible because each module 29 is mounted with play, particularly its rib 31, which can move vertically inside rail 42 of each of arms 9 and 10. In the example represented, magnets 11, 12 have a diameter of about 5 mm and a height of about 2 mm and can be disposed at a distance of between 1 and 5 mm from one another. Magnets 11, 12 are produced, for example, by sintering a neodymium iron boron or cobalt samarium powder, and have good temperature resistance.

The device comprises means 27 for inserting the hair between heating 3 and retaining 2 part. In the example represented in FIGS. 1*a*, 1*b* and 2, hair-inserting means 27 are embodied in the extension of the respective treatment surfaces 17 and 18, in the form of an outwardly curved insertion surface. In this example, each module 29 comprises a leading part 40 protruding from frame 4, the inner surface of leading part 40 forming an arc-shaped chamfer 41 that leads the hair to the level of the treatment surface of a plate 25. More particularly, the tangent to the rounded profile of arc-shaped chamfer 41, at the level of its junction with plate 25, is located at the level and in the extension of treatment surfaces 17, 18. Thus, two opposing arc-shaped chamfers 41 form a calyx shape that allows the hair to be directed to the level of the junction of the treatment plates.

In operation, after the device has been brought to temperature, the user takes a lock of hair in her hand and brings it to the level of arc-shaped chamfers 41, preferably placing the device as near as possible to the scalp. Chamfers 41 then cause the lock of hair to slide toward the inside of the device, the hair being automatically inserted between heating 3 and retaining 2 parts of the device, causing them to move apart. Retaining 2 and heating 3 parts move apart, thus adapting to the thickness of the lock of hair and to the variation in this lock along the length of their treatment surfaces. The user then moves the device along the lock of hair, from the root to the end of the hair, without having to exert any effort during the straightening process; the device comprising a housing with a fixed frame and its retaining 2 and heating 3 parts, which are maintained in contact by the force of the magnetic field, automatically adapt to the thickness of the lock of hair.

Figure 3A:
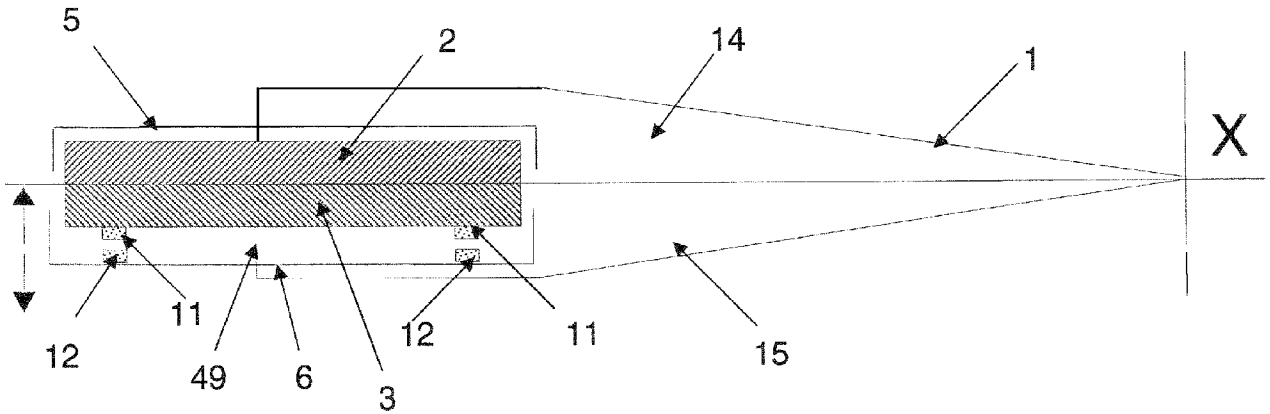
FIG. 3*a* is a simplified axial view of a device according to a second variant of embodiment of the invention.
Figure 3B:
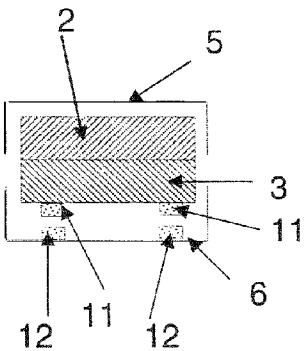
FIG. 3*b* is a front view of the device of FIG. 3*a;*

FIGS. 3*a* and 3*b* illustrate a device according to a second variant of embodiment of the invention, in which the elements identical to those above or having the same function as those above have retained the same reference numbers. The hair-styling device according to this second variant of embodiment comprises a handle 1 comprising two articulated arms made to elastically pivot by means of a spring (not represented) about the axis X of a joint located at one end of the handle, between an open position and a closed position of the arms. The articulated arms support, at their free ends, the means for shaping the hair. Thus, we see an upper arm 14 supporting housing 5 of a retaining part 2 and a lower arm 15 supporting housing 6 of a heating part 3. Housings 5, 6 can each be joined to their respective arms 14, 15, or can be made of one piece with the latter, for example by being made from a plastic material using an injection technique.

As in the preceding variant, heating part 3 may be heated electrically, by gas, by steam, or even by using a hot air flow from a fan. Heating part 3 comprises on its outer surface a hair treatment surface 18 having a generally rectangular shape (preferably, it has the same shape and the same dimensions as heating part 3 it covers) made from a heat-conducting material, polished and possibly covered with an enamel, a ceramic material, a glass coating, etc. Retaining part 2 can be a simple metal plate comprising, on its outer surface, a hair treatment surface 17 having a generally rectangular shape (preferably, it has the same shape and the same dimensions as retaining part 2 it covers), polished and possibly covered with an enamel, a ceramic material, a glass coating, etc. In a variant, retaining part 2 is made in the same way as heating part 3 and can also supply calories to the lock of hair to be treated. Handle 1 and the pivoting arms are embodied such that when the arms are in the open position, a lock of hair can be inserted between the arms, and when the arms are in the closed position, the hair is in pressure contact between treatment surfaces 17, 18.

Heating part 3 is float-mounted in its housing 6 with a play 49 that is visible in the figures, heating part 3 being maintained in magnetic floatation by the force of a repulsive magnetic field established between opposing permanent magnets 11 and 12. There are four of the permanent magnets 11, attached substantially at the corners of the inner surface of the heating part 3. Permanent magnets 12 are coaxial to permanent magnets 11 by virtue of being attached to the base of housing 6, and they are oriented so as to be in phase with permanent magnets 11, i.e., with their south poles facing the south poles of the opposing magnets (or with their north poles facing the opposing north poles). Permanent magnets 11, 12 in this example have a cylindrical shape, a diameter of about 7 mm, and a thickness of 4 mm and are separated by a distance of, for example, between 1 and 5 mm.

In operation, after the device is brought to temperature, the user inserts a lock of hair between heating 3 and retaining 2 parts of the device, preferably placing the device as near as possible to the scalp. She then exerts pressure on pivoting arms 14, 15 of handle 1 in order to close the device. Heating part 3, being placed on four pairs of permanent magnets, is magnetically floating and conforms perfectly to the variations in the thickness of the locks of hair, since the more the heating part is moved away from the retaining part, the more the distance between opposing magnets 11, 12 decreases and the more the pressure on the hair increases. The user then moves the device along the lock of hair, from the root to the end of the hair, while holding the device closed.

In a variant, retaining part 2 may be magnetically float-mounted by adopting the same structure as described above. The retaining part may be heating or non-heating. In yet another variant, the retaining part and the heating part are each magnetically float-mounted.

Other variants of devices will now be described with reference to FIGS. 4*a*, 4*b* and 5*a*, 5*b*, their operation being based on the principles described above.

Figure 4A:
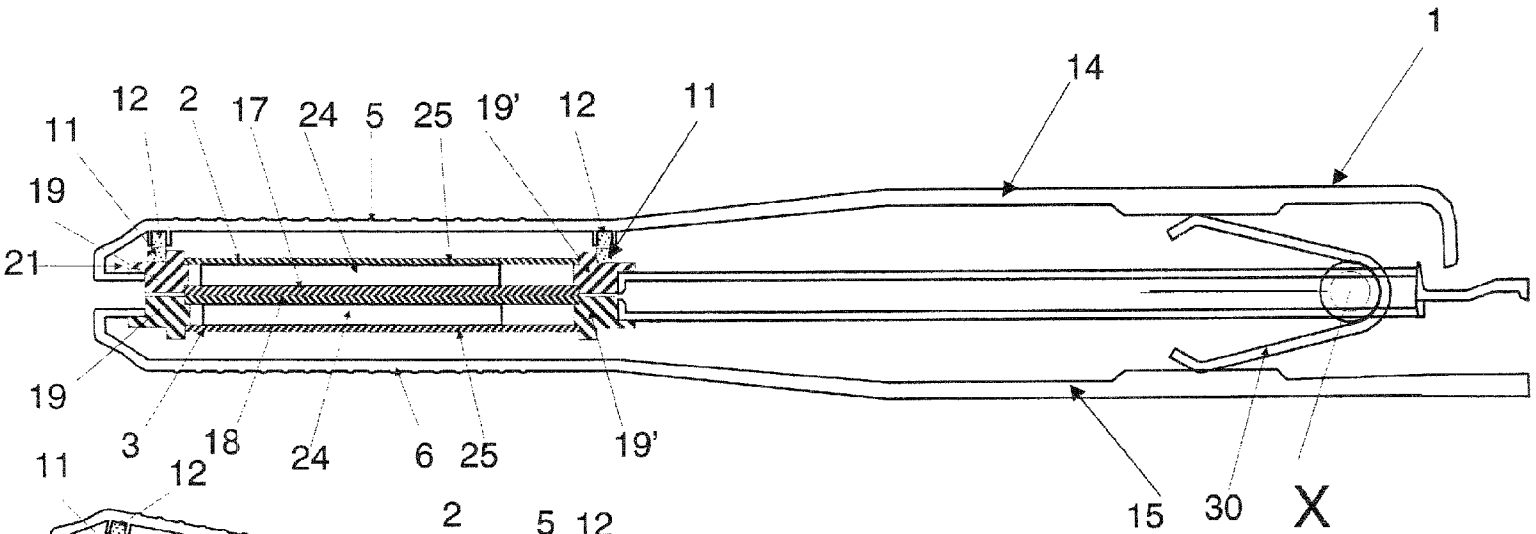
FIG. 4*a* is an axial sectional view of a device according to the second variant of embodiment of the invention represented in a working position.
Figure 4B:
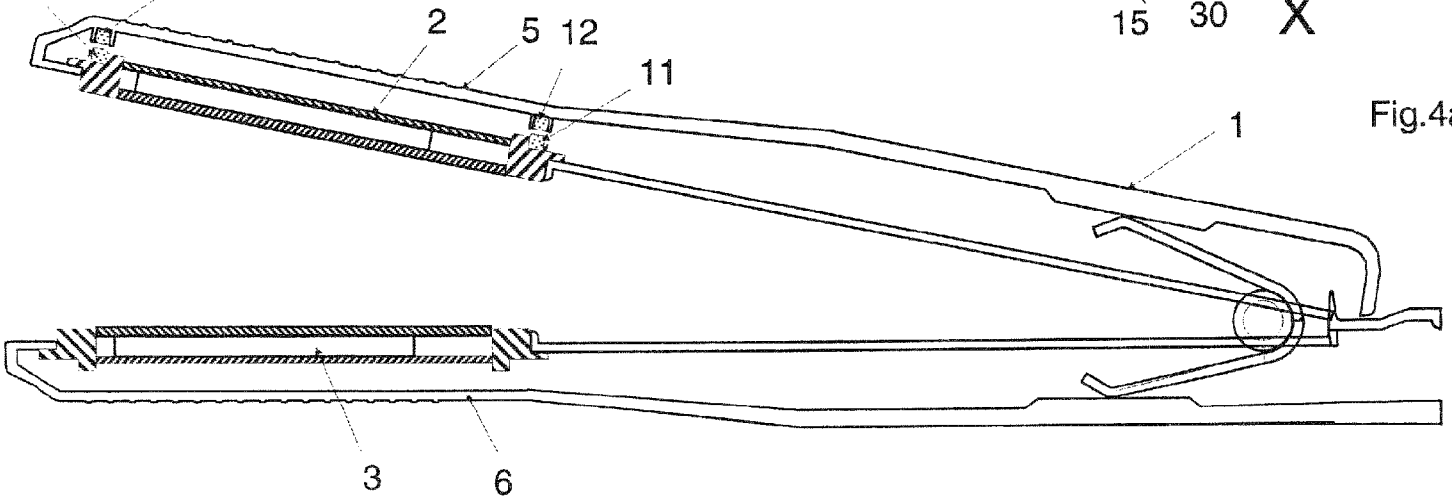
FIG. 4*b* is a similar view showing the device of FIG. 4*a* in a resting position.

The device represented in FIGS. 4*a* and 4*b* is a straightening device comprising a handle 1 comprising two articulated arms 14, 15 made to elastically pivot by means of a spring 30 about the axis X of a joint located at one end of the handle, between an open position and a closed position of the arms. Articulated arms 14, 15 support, at their free ends, the means for shaping the hair, including a retaining part 2 mounted in its housing 5 and a heating part 3 mounted in its housing 6. Housings 5, 6 of the shaping means are each made of one piece with their respective pivoting arms 14, 15. Retaining 2 and heating 3 parts each comprise an electric heating element 24, which may be a resistive heating element, having a PTC, or infrared-emitting heating element, etc. The heating element of each part is sandwiched between a plate forming a respective hair treatment surface 17 or 18 and a base plate 25. Such an assembly is limited at its end by two plug fittings 19, 19' and may be embodied in the form of a module in order to facilitate its mounting inside its respective housing. Each plug fitting 19, 19' associated with retaining part 2 contains a permanent magnet 11, opposing permanent magnets 12 being attached to the base wall of housing 5. In a variant, two magnets are placed on the periphery of each plug fitting end. The opposing magnets are mounted in phase. The device also comprises guide means 21 that enable an upward translational movement of retaining part 2 in the direction of its housing 5, and a certain pivoting movement of retaining part 2 about an axis contained in the plane of treatment surface 17 when it is at rest.

In operation, after the device is brought to temperature, the user inserts a lock of hair between heating 3 and retaining parts 2 of the device, preferably placing the device as near as possible to the scalp. She then exerts pressure on pivoting arms 14, 15 of handle 1 in order to close the device. Retaining part 2 being placed on two, or even four, pairs of permanent magnets, it is magnetically floating and conforms perfectly to the variations in the thickness of the locks of hair, since the more the heating part is moved away from the retaining part, the more the distance between opposing magnets 11, 12 decreases and the more the pressure on the hair increases. During the straightening process, retaining 2 and heating 3 parts move apart, thus adapting to the thickness of the lock of hair and compensating for any geometric flaws due to the structure of the device. The user then moves the device along the lock of hair, from the root to the end of the hair, while holding the device closed.

Figure 5A:
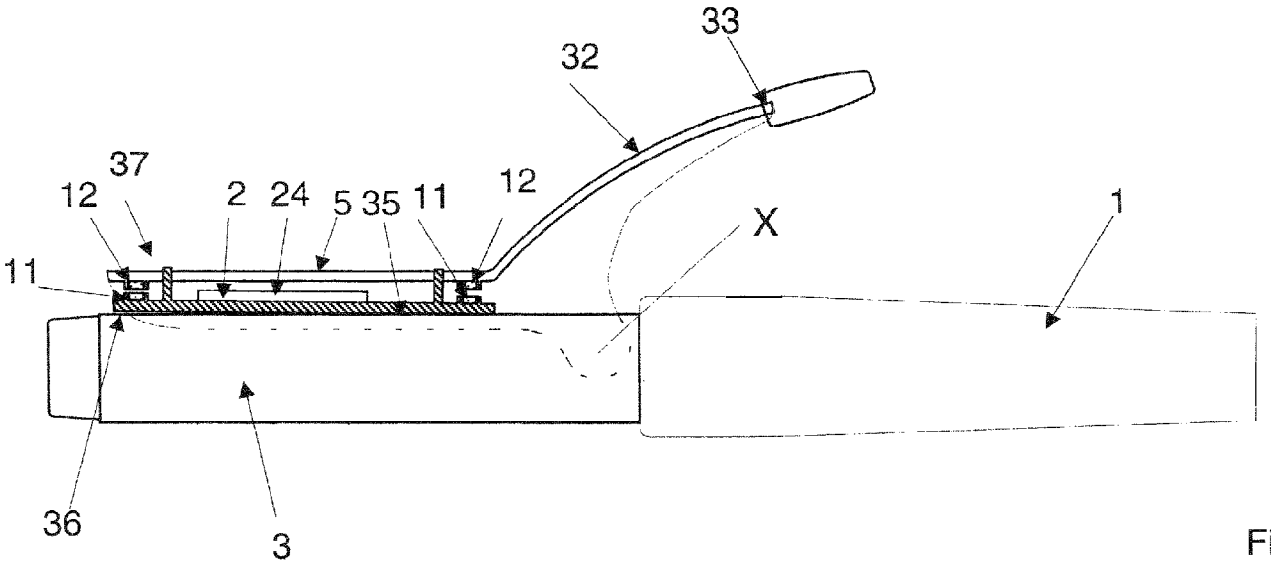
FIG. 5*a* is an axial sectional view of a device according to a third variant of embodiment of the invention represented in the working position.
Figure 5B:
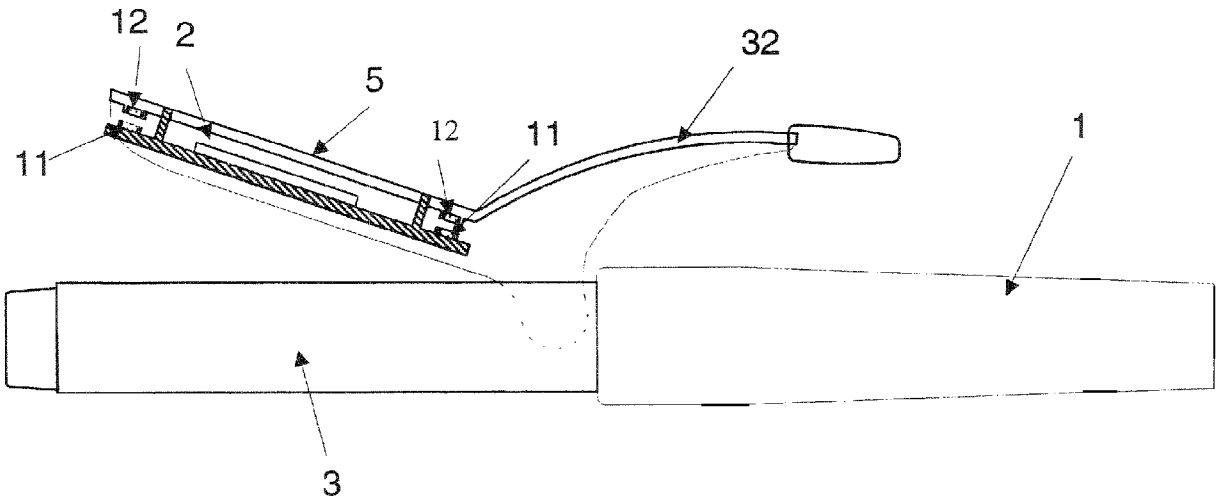
FIG. 5*b* is a similar view showing the device of FIG. 5*a* in the resting position.

The device represented in FIGS. 5*a* and 5*b* is a curling iron comprising a handle 1 extended by a cylindrical heating part 3 that contains an electric heating element (not represented). A pincer 32 is made to elastically pivot about an axis of articulation X, under the pressure of a spring (not represented) that maintains pincer 32 in contact with heating part 3. Pincer 32 comprises, at one of its ends, an actuating lever 33 for opening the pincer and is extended at the opposite end by housing 5 of a retaining part 2. Retaining part 2 comprises an arc-shaped plate 35 that comes in contact with the cylindrical treatment surface 36 of heating part 3. Two permanent magnets 11 are mounted on the ends of the inner surface of plate 35. Magnets 11 are disposed radially relative to the longitudinal axis of heating part 3 and hence of plate 35. Opposing permanent magnets 12 are attached to the base wall of housing 5. The opposing magnets are mounted in phase. Plate 35 also comprises radial guide means 37, which allow it to pivot slightly about an axis parallel to axis X. Retaining part 2 also comprises an electric heating element 24, which can be activated independently from that of heating part 3. In a variant (not represented in the drawings), the heating mandrel can cooperate with two retaining parts 2.

In operation, after the device is brought to temperature, the user opens pincer 32 and inserts a lock of hair between the mandrel or heating part 3 and plate 35; the lock may simply be gripped or may be wound around the mandrel prior to closing pincer 32. The user then releases lever 33, thus closing pincer 32. During the winding of the hair, retaining 2 and heating 3 parts move apart, thus adapting to the thickness of the lock of hair and compensating for any geometric flaws due to the structure of the device. After a certain period of heat exchange with heating part 3, possibly supplemented by heat from retaining part 2, the user opens the pincer and extracts the lock of hair thus shaped.

Other variants and embodiments of the invention may be considered without going beyond the scope of its claims.

Thus, the magnetic field may be produced by replacing the permanent magnets with an electromagnet.

Moreover, the principle of the invention may be applied to other types of hairstyling devices, including crimping or curling irons comprising plates having a raised profile or comprising opposing protuberances.

This application relates to subject matter disclosed in French Application Number FR 07 01644, filed on Mar. 7, 2007, the disclosure of which is incorporated herein by reference.

The foregoing description of the specific embodiments will so fully reveal the general nature of the invention that others can, by applying current knowledge, readily modify and/or adapt for various applications such specific embodiments without undue experimentation and without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation. The means, materials, and steps for carrying out various disclosed functions may take a variety of alternative forms without departing from the invention.

Thus the expressions "means to . . . " and "means for . . . ", or any method step language, as may be found in the specification above and/or in the claims below, followed by a functional statement, are intended to define and cover whatever structural, physical, chemical or electrical element or structure, or whatever method step, which may now or in the future exist which carries out the recited function, whether or not precisely equivalent to the embodiment or embodiments disclosed in the specification above, i.e., other means or steps for carrying out the same functions can be used; and it is intended that such expressions be given their broadest interpretation.

What is claimed is:

1. A hairstyling device comprising:

a handle;

a first housing joined to said handle and containing at least one heating part; and a second housing joined to said handle and containing a retaining part with which said heating part cooperates, wherein at least one of said heating part and said retaining part is float-mounted inside its respective housing, and said device is constructed to enable hair to be inserted between said heating part and said retaining part, and further wherein said device further comprises at least one first magnet mounted on a selected one of said at least one heating part and said retaining part and at least one second magnet mounted on said housing containing said selected one of said at least one heating part and said retaining part, said first and second magnets facing one another and being mounted with a relative orientation to magnetically repel one another.

2. The device according to claim 1, wherein said at least one first magnet comprises at least two first permanent magnets each disposed substantially at a respective end of said one of said at least one heating part and said retaining part, and said at least second magnet comprises at least two second permanent magnets each facing a respective one of said two first permanent magnets.

3. The device according to claim 1, wherein said retaining part is a heating part.

4. The device according to claim 1, wherein said retaining part or said at least one heating part has a hair treatment surface that is of flat form or undulating form.

5. The device according to claim 4, wherein said hair treatment surface defines a plane, and further comprising means for guiding said at least one heating part or said retaining part, disposed in a midplane perpendicular to the plane of said hair treatment surface or on either side of said plane.

6. The device according to claim 1, wherein said at least one heating part has a hair treatment surface having a shape generated by surface of revolution, and said retaining part has a treatment plate that conforms to the shape of said at least one heating part.

7. The device according to claim 6, further comprising means for radially guiding said retaining part.

8. The device according to claim 1, wherein said handle has a longitudinal axis and said first and second housings are mounted to pivot relative to one another about an axis perpendicular to the longitudinal axis of said handle.

9. The device according to claim 1, wherein said first and second housings are mounted so as to be fixed relative to said handle, and said device further comprises means for inserting hair between said at least one heating part and said retaining part.

10. The device according to claim 1, further comprising means for adjusting the force of the magnetic field between said at least one first magnet and said at least one second magnet.

11. A hairstyling device comprising:

a handle;

a first housing joined to said handle and containing at least one heating part; and a second housing joined to said handle and containing a retaining part with which said heating part cooperates, wherein at least one of said heating part and said retaining part is float-mounted inside its respective housing, and said device is constructed to enable hair to be inserted between said heating part and said retaining part, and further wherein said device further comprises magnetic means-mounted on a selected one of said at least one heating part and said retaining part for producing a magnetic repulsive force that urges said selected one of said at least one heating part and said retaining part away from said housing containing said selected one of said at least one heating part and said retaining part.

12. The hairstyling device of claim 1, wherein said at least one first magnet is mounted on said at least one heating part and said at least one second magnet is mounted on said first housing.

13. The hairstyling device of claim 1, wherein said at least one first magnet is mounted on said retaining part and said at least one second magnet is mounted on said second housing.

14. The hairstyling device of claim 11, wherein said magnetic means are mounted on said at least one heating part for producing the magnetic repulsive force that urges said at least one heating part away from said first housing.

15. The hairstyling device of claim 11, wherein said magnetic means are mounted on said retaining part for producing the magnetic repulsive force that urges said retaining part away from said second housing.

* * * * *